United States Patent [19]

Best et al.

[11] Patent Number: 5,054,150

[45] Date of Patent: Oct. 8, 1991

[54] FORKLIFT MOUNTED SWEEPING MACHINE

[75] Inventors: Dan F. Best; James A. Best, both of Jonesboro, Ark.

[73] Assignee: Best Industries, Inc., Jonesboro, Ark.

[21] Appl. No.: 531,064

[22] Filed: May 31, 1990

[51] Int. Cl.[5] ..... E01H 1/04; A47L 11/18

[52] U.S. Cl. ..... 15/52.1; 15/82; 15/83; 15/340.4

[58] Field of Search ..... 15/83, 82, 84, 340.3, 15/340.4, 79.2, 52.1, 50.3

[56] References Cited

U.S. PATENT DOCUMENTS

| | | | |
|---|---|---|---|
| 2,283,229 | 5/1942 | Richards . | |
| 2,684,496 | 7/1954 | Lull | 15/83 |
| 3,354,489 | 11/1967 | Ehrlich | 15/83 |
| 3,950,811 | 4/1976 | Larson . | |
| 4,001,908 | 1/1977 | Franklin | 15/83 |
| 4,214,338 | 7/1980 | Kyle | 15/83 |
| 4,675,935 | 6/1987 | Kasper et al. | 15/319 |
| 4,819,290 | 4/1989 | Schulte | 15/83 |
| 4,979,260 | 12/1990 | Holsten et al. | 15/83 |

FOREIGN PATENT DOCUMENTS

| | | | |
|---|---|---|---|
| 1524953 | 9/1978 | United Kingdom | 15/83 |
| 2160091 | 12/1985 | United Kingdom | 15/83 |

*Primary Examiner*—Edward L. Roberts
*Attorney, Agent, or Firm*—Dowell & Dowell

[57] ABSTRACT

A sweeping machine which includes a debris collection hopper and filter assembly which is readily attached to the lift bars of a conventional forklift so as to be manipulated both horizontally and vertically by the forklift and which is mounted thereto so as to float relative to the forklift in order to follow the contour of the surface being swept.

12 Claims, 5 Drawing Sheets

FORKLIFT MOUNTED SWEEPING MACHINE

BACKGROUND OF THE INVENTION

1. Field of the Invention This invention is generally directed to sweeping machines of the type used in industrial areas and in parking lots and more specifically to sweeping or cleaning machines which are specifically designed to be powered and transported by conventional forklifts. The invention incorporates a hydraulically powered sweeping machine wherein hydraulic power to the motors and fan units is derived directly from a hydraulic system mounted thereto which is controlled by an operator from the forklift. In addition, the sweeping machine includes a main support frame for supporting the components of the sweeping machine relative to a surface being swept and which frame also acts as a hydraulic fluid reservoir. The sweeping machine is designed to permit not only sweeping but filtering of air which has been swept into the unit's hopper so that dust is not recirculated within a confined shop or industrial space and thus facilitates working conditions in such areas.

2. History of the Related Art

Due to the ever increasing awareness of the need to preserve good environmental conditions in industrial areas and work shops and the like, a great deal of inventive effort has been directed to facilitate the manner in which such areas are treated not only to remove dirt and debris but also to such machines which have the ability to protect air quality by filtering the air which is passed through such machines during use. An early example of a mechanized cleaning device for use in industrialized areas is disclosed in U.S. Pat. No. 2,283,229 to Richards. This patent discloses a manually maneuvered sweeping machine which includes a motor driven cylindrical brush which sweeps debris from the surface into a bin after which air within the machine passes through filter elements suspended above the bin before the air is exhausted to atmosphere. To provide cleaning in edge or corner areas, the unit also incorporates a forward leading offset rotary brush which acts to sweep debris from corners and edge wall areas toward the central portion of the cleaning machine where such debris will be acted upon by the primary cylindrical brush. Unfortunately, such a machine which is manually maneuvered is not adequate nor efficient for cleaning large industrial spaces as the machine is limited in size so as to be easily handled by an individual. Further, such a machine would require a great deal of manual effort to discharge dirt and debris which has been collected by removing the collection bin from the machine and thereafter manually dumping the material therefrom afterwhich, the bin must be remounted to the machine.

In order to overcome the disadvantages of smaller manually maneuvered cleaning machines, a number of patents have been directed to providing sweepers which may be attached to other prime movers. For instance, in U.S. Pat. No. 3,950,811 to Larson, a sweeper attachment is disclosed which is designed to be maneuvered by a forklift by being directly attached to the under frame or chassis of the forklift truck. The unit includes a cylindrical sweeper brush mounted within a housing which is powered by mechanical connection to support wheels also mounted within the sweeper housing. Unfortunately, with this kind of unit, the power to the brush is determined by the surface contact of the wheels with the surface being cleaned. This type of power is not sufficient to adequately clean shop areas, driveways, parking lots and related surfaces especially under conditions wherein surfaces are not level. In addition, the unit must be designed to be raised from a surface when the a forklift is moved in a sideways direction in order to prevent damage to the wheels and brush of the unit. Also, the unit must be manually disengaged from the forklift in order to permit dumping of debris from the unit's collection receptacle. Dust and other materials meanwhile are collected on oil pads. The collection of dust ladened air on oily surfaces does not provide adequate filtration to promote a safe environment and is therefore not adequate.

In order to increase maneuverability of industrial sweepers of the type which are powered by a secondary prime mover, U.S. Pat. No. 4,214,338 to Kyle discloses an industrial sweeper which may be directly mounted to the lift forks of a forklift truck. This type of unit however utilizes a sweeper which is powered by a mechanical drive connection to the support wheels of the sweeping apparatus and therefore relies on the rotation of the support wheels to generate power to the sweeping brush. As with other types of industrial sweepers which utilize ground contact to generate power, such power generation is not sufficient to adequately clean industrial areas especially when surface areas are irregular.

Additional industrial sweeping machines which are specifically designed to be supported and manipulated by conventional industrial forklift trucks are disclosed in U.S. Pat. No. 4,675,935 to Kasper et al. and U.S. Pat. No. 4,819,290 to Schulte. In Schulte, a single rotary brush is powered by a hydraulic motor so as to sweep debris into a collection bin which may be tipped when the unit is raised by the forklift mechanism of the forklift truck. There is, however, no provision for powering the unit utilizing any controls from the forklift and the unit is fixedly secured to the forks of the forklift and therefore is not independently vertically adjustable with respect thereto so as to permit the unit to follow varying contours in the surface areas which are being swept. Likewise, in Kasper et al., the unit is not free to float vertically relative to the forklift mechanism of the forklift truck and therefore cannot follow irregular surface contours. Also, the unit in Kasper et al. does not provide an easy means for allowing debris to be discharged from the machine after an area has been cleaned.

An additional example of prior art industrial sweepers which are designed to be maneuvered by a separate vehicle is disclosed in U.S. Pat. No. 4,001,908 to Franklin.

SUMMARY OF THE INVENTION

This invention is directed to a sweeping machine which includes a debris collection hopper and filter assembly which are pivotably attached to a main support frame so that the hopper may be discharged when the sweeping machine is elevated with respect to a surface which has been swept through the operation of at least one hydraulic cylinder which is controlled by the equipment operator. The sweeping machine is designed to be readily attached to the vertical lift bars of a conventional forklift so that the machine is manipulated both horizontally and vertically by the forklift. The main frame of the machine is mounted on a plurality of wheels with the frame being attached to the forklift through a connection which permits the frame to float vertically relative to the forklift so that the frame is allowed to follow the contour of a surface being swept but which also allows the sweeping machine to be elevated by the forklift so that the unit may be raised above a collection receptacle in order to permit the automatic dumping of the sweeper hopper.

The sweeping machine includes a main cylindrical brush which functions to sweep debris into the sweeper hopper and also includes a fan assembly which draws air through the hopper and through a filter which functions to remove dust from air being exhausted from the machine. To facilitate the sweeping of corner areas, a separate rotary brush is mounted in offset relationship with respect to the frame so as to extend slightly outwardly therefrom. The rotary brush will sweep debris into the path of the machine so that such debris will be acted upon by the main sweeping brush. The fan motor and rotary and cylindrical brush motors are all hydraulically powered with the frame of the sweeping machine serving as a fluid reservoir for hydraulic fluid. Control of the motors and fan unit is accomplished by controls mounted on the forklift truck s that the motors may be controlled by the forklift operator.

It is the primary object of the present invention to provide a sweeping machine which may be readily mounted to the lift bars of a conventional forklift truck and which includes a main frame which is connected to the lift bars of the forklift truck in such manner that the machine is allowed to move vertically independently of the forklift so that the unit will follow the contour of a surface being swept.

It is also an object of the present invention to provide a sweeping machine which includes a plurality of hydraulic motors for operating the cleaning brushes and where the reservoir for the hydraulic fluid is provided within the support frame assembly of the sweeping machine.

It is yet a further object of the present invention to provide a sweeping machine which may be readily attached to the lift bars of a conventional forklift truck wherein all air exhausted from the sweeping machine is filtered so as to preserve the air quality within an area in which the machine is in use.

It is also an object of the present invention to provide a sweeping machine which is selectively attachable to the lift bars of a conventional forklift truck and which includes a hopper in which debris may be collected and which machine may be raised by the lift bars of the forklift truck so that the hopper may be elevated above a collection receptacle and thereafter selectively pivoted to dump debris retained therein so that no manual effort is required to remove debris from the collection hopper.

DESCRIPTION OF THE PREFERRED EMBODIMENT

Figure 3:
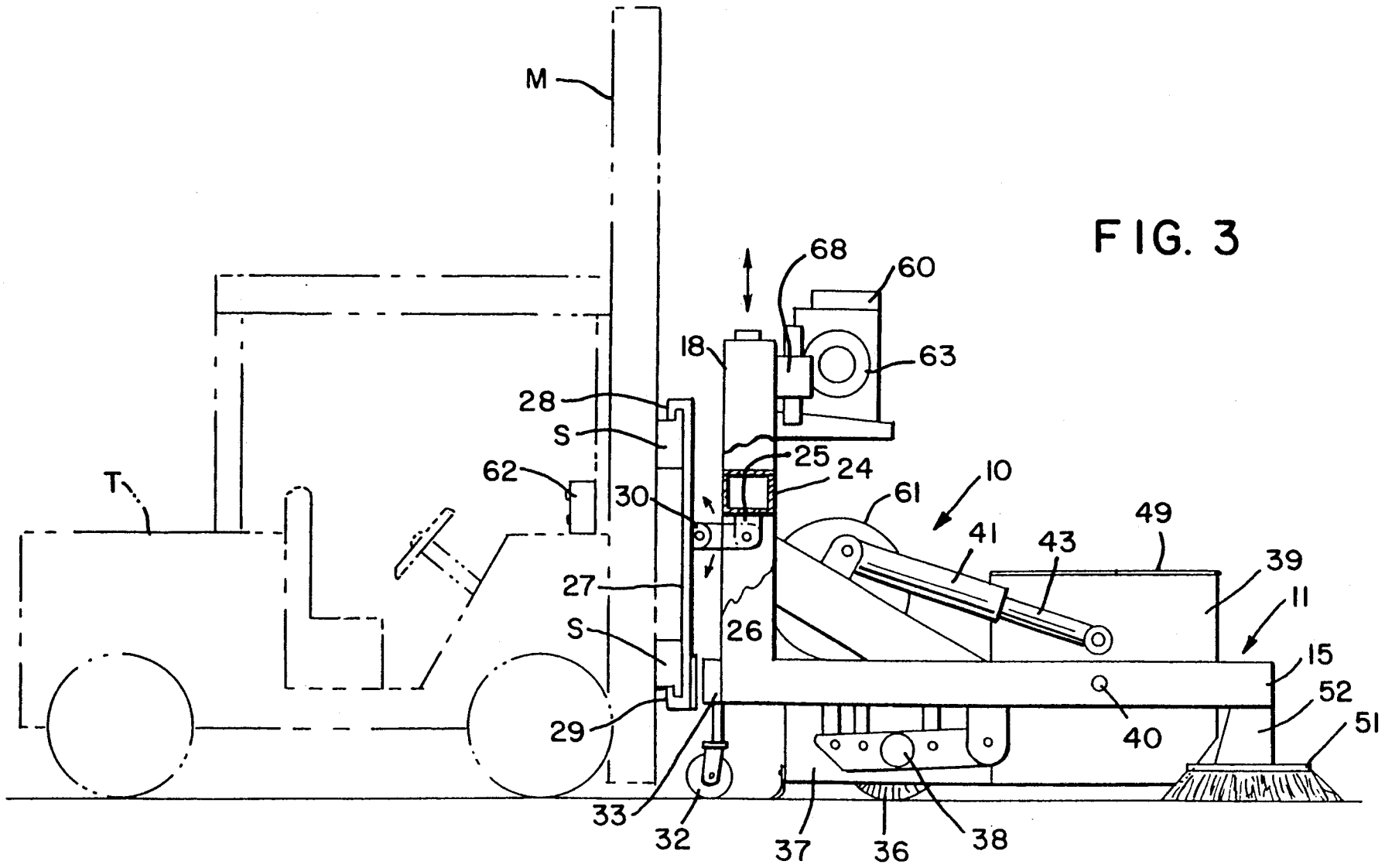
FIG. 3 is a right side elevational view of the sweeping machine of FIG. 1 showing a sweeping machine being attached to a conventional forklift truck.

With continued reference to the drawings, sweeping machine 10 of the present invention is shown as including a main frame 11 formed of rectangular steel tubing. The main frame includes front and rear beams 12 and 13 and side beams 14 and 15 and vertical extensions 16, 17 and 18 which are connected at their uppermost portions by an upper beam element 19. The upright frame assembly which includes vertical members 16, 17, 18 and the beam 19 are hollow and form a fluid reservoir in which hydraulic fluid is stored with the opening into the reservoir being through fluid supply opening 20. The upright frame assembly is reinforced by a pair of diagonal frame elements 21 and 22. The upright frame also includes a pair of horizontally oriented reinforcing beams 23 and 24 having a pair of attachment lugs 25 depending generally centrally therefrom. The lugs include aligned openings through which a bolt or other connector may be selectively received so as to connect a pivotable connection link 26 thereto as is shown in FIGS. 3 and 4.

The frame 10 of the present invention is specifically designed to be quickly mounted to the upper and lower horizontal lift bars S which are movably mounted on the mast M of a conventional forklift truck T. In order to mount the frame 10 to the lift bars of the forklift, a pair of vertical mounting brackets 27 are provided having upper and lower opposing inwardly directed flanges 28 and 29 which extend behind the upper and lower edges of the bars as is shown in FIG. 3. In this manner, the mounting plates 27 may be slidingly engaged over the shoes so that no separate connector is necessary to secure the mounting plates with respect thereto. Each mounting plate includes a pair of outwardly extending lugs 30 having aligned openings therein through which a cotter pin or other connector may be placed in order to secure the remote end of the connector links 26 thereto. In this manner, the connector links may be pivoted with respect to the lugs 30. Thus, the mounting arrangement will permit the frame 10 to move vertically as indicated by the arrow in FIG. 3 as the frame is allowed to float relative to the lift bars of the forklift through a pivoting arrangement with link 26 pivoting relative to the lugs 30. The frame 10 is mounted on four wheel assemblies 32 so that as the frame traverses a given surface area the frame will be supported by the wheels and will float relative to the lift bars S of the forklift through the pivoted link connection shown at 26.

Figure 4:
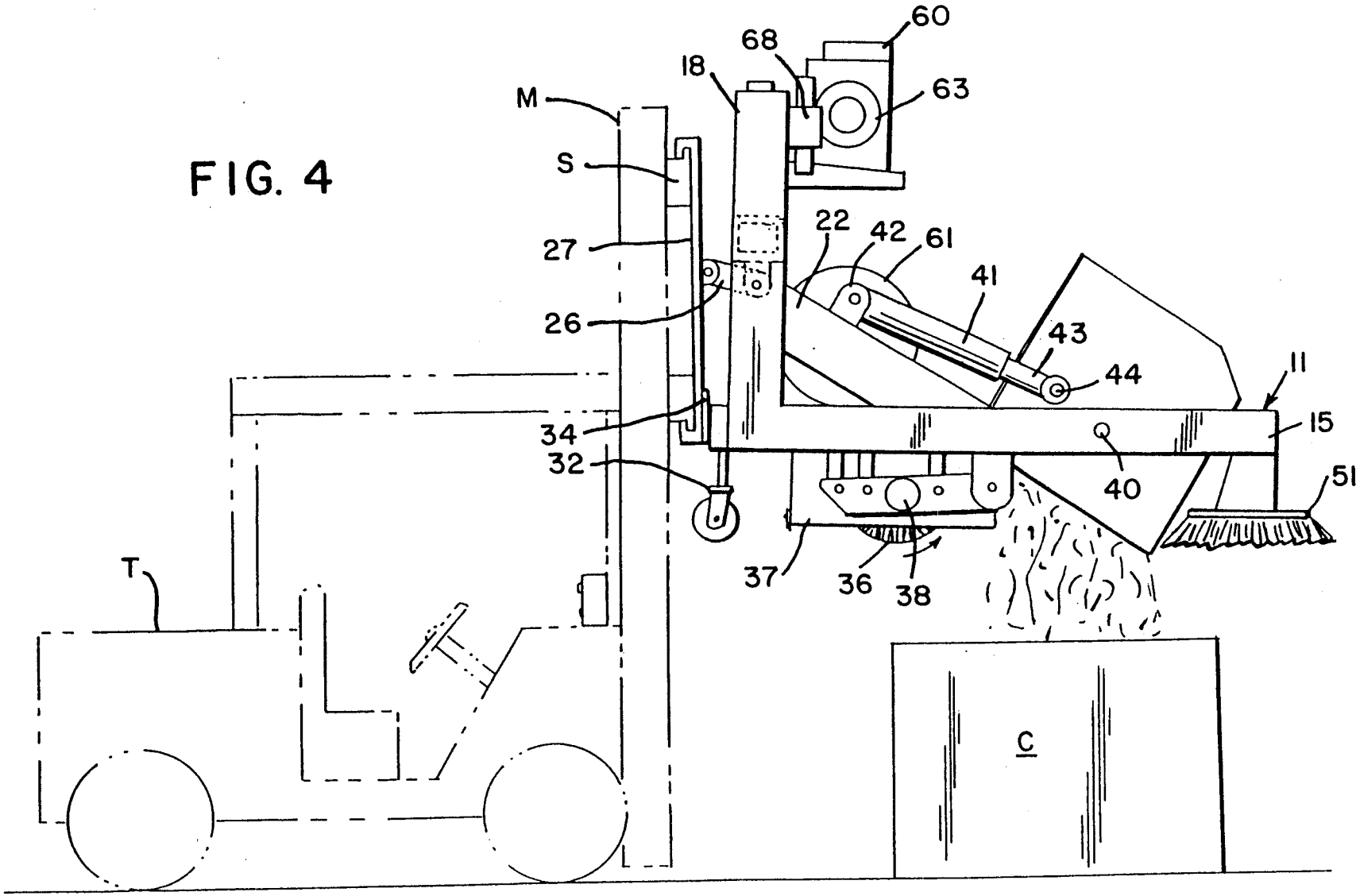
FIG. 4 is right side elevational view of the sweeping machine of FIG. 1 showing the sweeping machine being elevated in a position to dump debris from the collection hopper with the sweeper being mounted to a conventional forklift truck.

In order to stabilize the frame when the frame is lifted by the lift bars of the forklift as is shown in FIG. 4, a wear plate 33 is welded or otherwise secured to the rear and lowermost portion of the frame. The wear plate is designed to abut an opposing wear plate 34 mounted on each of the mounting plates 27.

Figure 5:
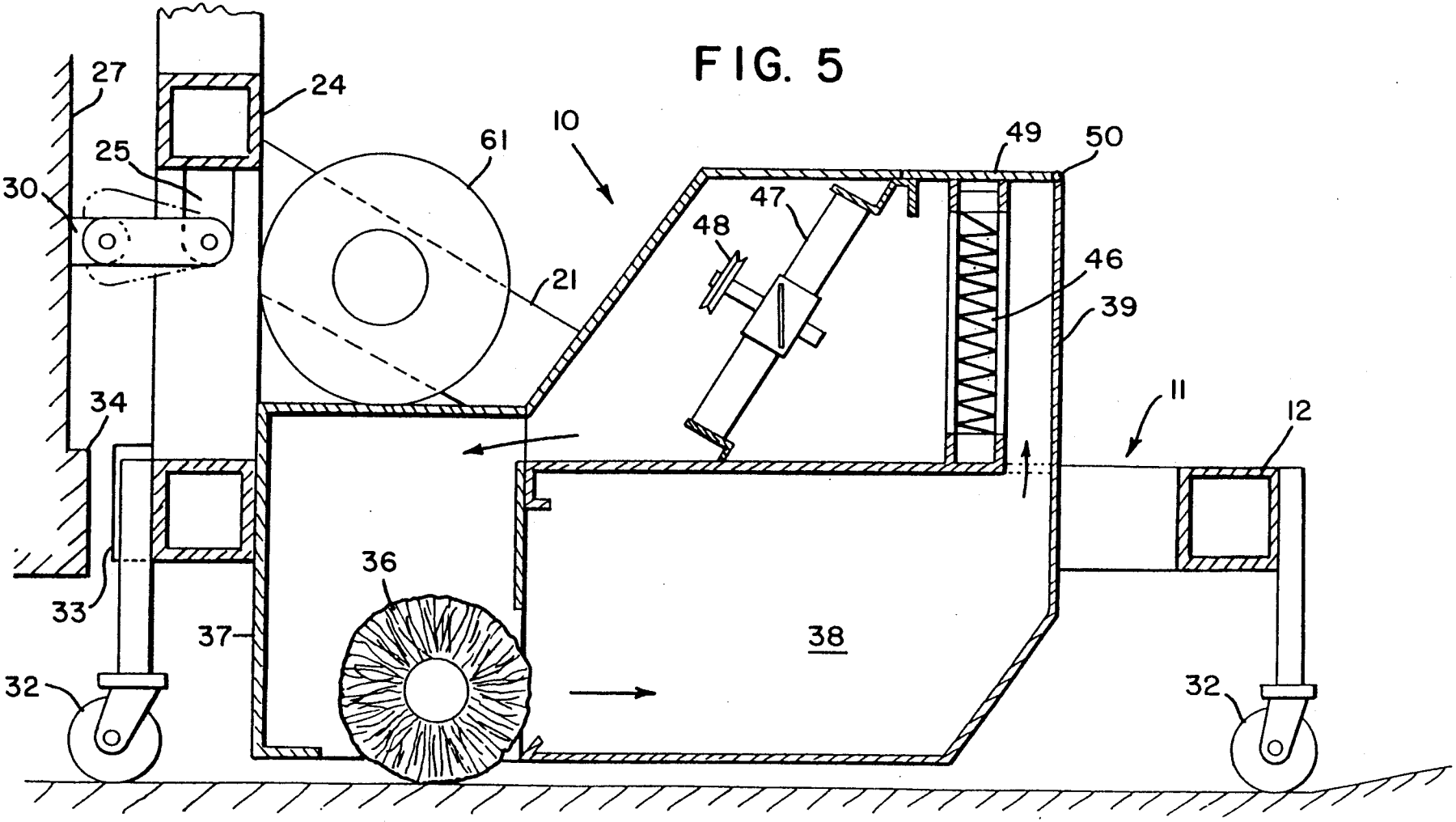
FIG. 5 is an enlarged cross-sectional view taken through the sweeping machine of FIG. 1.

The sweeping machine includes a main cylindrical sweeping broom 36 which is mounted in opposing bearings through the side walls of a rear housing 37 which is fixedly secured to the frame 11. The main sweeping brush or broom 36 is preferably formed of union fiber and wire and is driven by a hydraulic motor 38 so as to be rotatable in a counterclockwise direction as shown by the arrow in FIG. 4. The broom 36 sweeps the surface and discharges debris into a collection hopper 38 defined in the lower portion of pivotable housing 39 mounted forwardly of the drum 36 as is best shown in FIG. 5. The pivotable housing 39 is mounted to the side beams 14 and 15 of the frame 11 by a pair of pivot pins 40 with the movement of the housing 39 being controlled through hydraulic cylinder 41 which is mounted to bracket assembly 42 carried by the reinforcing beam 22. The cylinder 41 includes an extension rod 43 which is pivotably connected at 44 to the side wall of housing 39. By selective operation of the hydraulic cylinder 41, the hopper 38 may be pivoted from the position shown in FIG. 3 wherein the hopper is oriented to receive debris being swept therein by the main broom 36 to a dumping position as illustrated in FIG. 4. In this manner, the hopper 38 may be emptied without requiring any manual maneuvering of the housing 39 and thus greatly facilitate the handling of debris collected by the sweeper unit.

Also mounted within housing is filter 46 and a fan 47. The fan 47 is driven through a pulley arrangement 48 by drive belts which are connected to a hydraulic motor mounted within the housing 39, both of which motor and drive belts are not shown in the drawing figures. The fan is operable in order to draw dust ladened air from the hopper through the filter element and thereafter returns the filtered air into the upper portion of the fixed housing 37 in which the main broom is mounted. In this way, the sweeping machine eliminates the creation of any dust in the vicinity being swept. In order to remove the filter 46, a door 49 is provided in the upper portion of housing 39 which door is pivotable about pivot pins 50 formed along the front wall of the housing 39. Prior to dumping debris from the hopper 38, the fan may be driven in reverse in order to dislodge dust and other particles collected on the filter.

Figure 1:
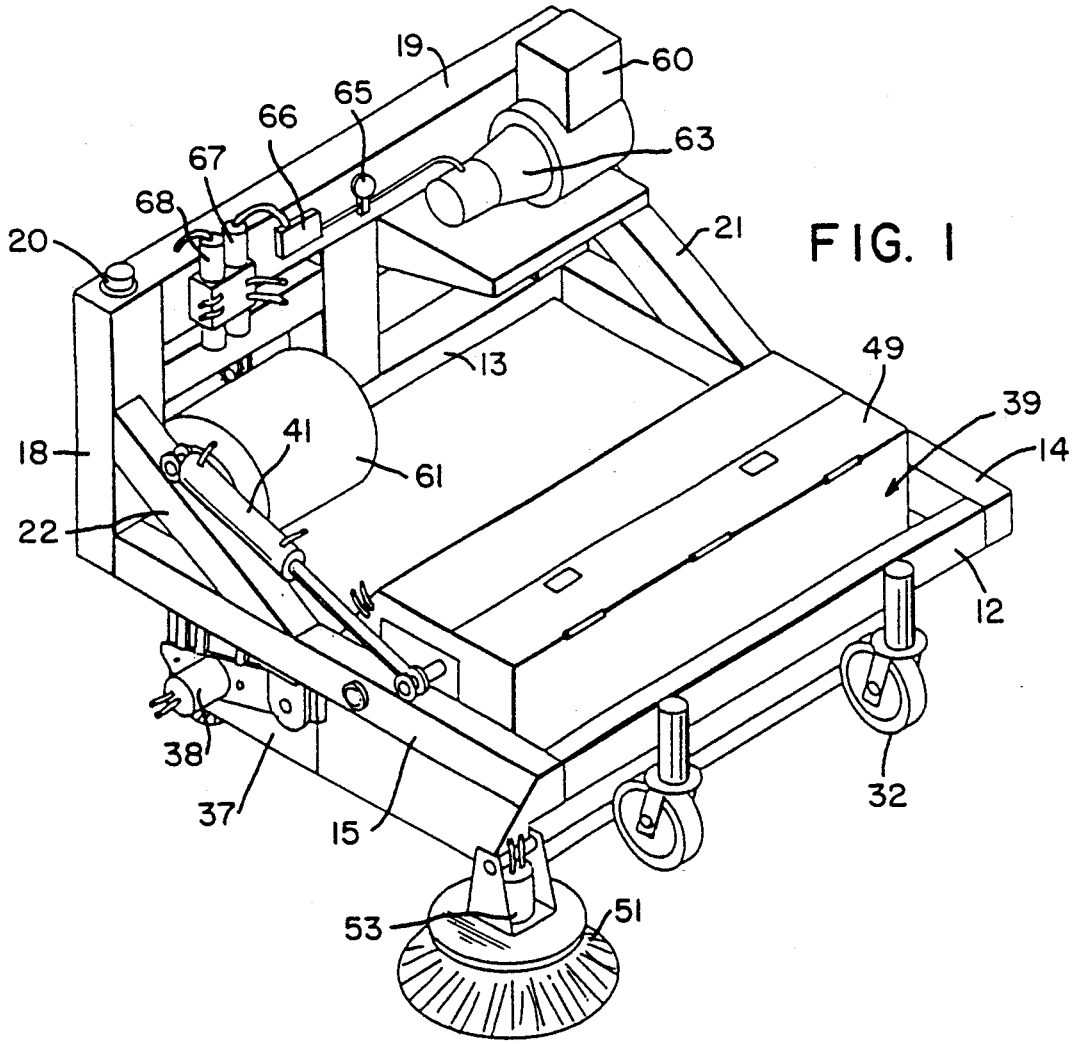
FIG. 1 is a perspective view of the sweeping machine of the present invention.
Figure 2:
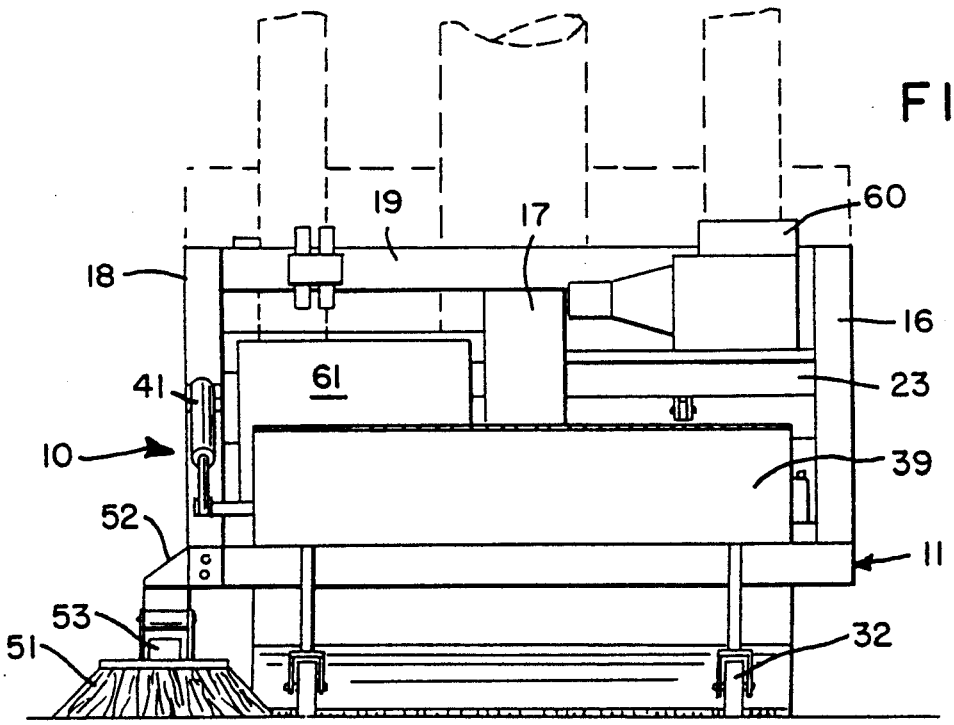
FIG. 2 is a front plan view of the sweeping machine shown in FIG. 1 showing in dotted line portions of a conventional forklift truck.

The sweeping machine is also provided with a gutter broom 51 which is a rotary broom which rotates to direct debris toward the center or main path of the sweeping machine. The broom 51 is mounted to an extension 52 so that the broom extends laterally of the side of the frame as is shown best in FIG. 2 of the drawings. The broom is powered by a hydraulic motor 53. In operation, the gutter broom turns in a counterclockwise direction in order to draw debris from curbs, machinery and shelving bases and deposits the material in the path of the main broom of the sweeping machine.

In order to provide power to each of the hydraulic motors associated with the sweeping machine, an internal combustion engine 60 is provided which receives fuel in the way of compressed gas from tank 61. The engine is started through starter motor (not shown) which is operated by a control panel 62 mounted in the forklift so a to be convenient to the operator of the forklift as is shown in FIG. 3. The engine 60 powers pump 63 which is utilized to supply pressure to the hydraulic system to power either the hydraulic cylinder 41, the main broom drive motor 38, the supplemental rotary broom drive motor 53 and the drive motor for the fan 47. In order not to complicate the drawing figures, only some end portions of the various hoses utilized in the fluid system are shown. Reference to the fluid circuit shown in FIG. 6 is made with respect to the operation of the hydraulic system.

Figure 6:
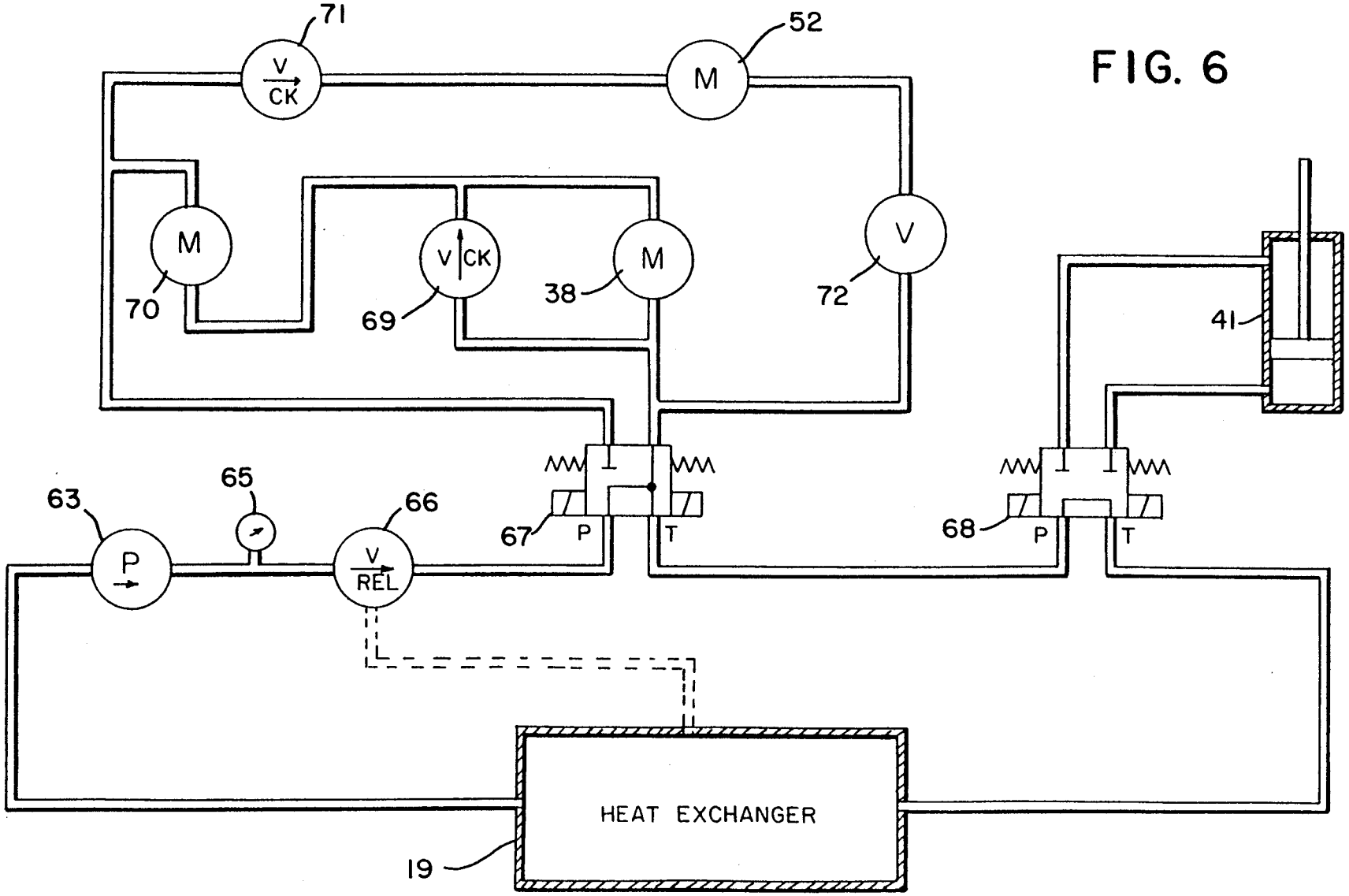
FIG. 6 is the hydraulic circuit diagram for the sweeping machine of FIG. 1.

With specific reference to FIG. 6, the hydraulic system includes the pump 63 which takes hydraulic fluid from the reservoir mounted within the upright frame as was previously discussed and supplies the fluid through pressure gauge 65 and through a relief valve 66. Fluid is thereafter directed to a pair of three position solenoid valves 67 and 68. Hydraulic fluid is directed through the solenoid 67 to each of the drive motors associated with the main broom, the auxiliary or gutter broom and the motor for the fan. It is noted that a first check valve 69 is provided between the main broom motor 38 and the motor 70 for the fan. A second check valve 71 is mounted between the fan motor and the gutter broom motor 52 with a needle valve 72 being provided between the motor 53 and the solenoid valve 67. Hydraulic fluid from solenoid valve 68 is directed to the opposite sides of the hydraulic cylinder 41.

In use, the sweeping machine 10 of the present invention is easily mounted to the vertical lift bars of a conventional forklift by first removing the forks associated therewith and thereafter placing the mounting plates 27 on the vertical lift bars as shown in FIGS. 3 and 4. Thereafter, the links 26 are attached to the lugs by a cotter pin or other connector. In practice, the links 26 may be of sufficient length to permit the frame 11 of the sweeping machine to float vertically relative to the forklift a distance of approximately eight inches. By utilizing the control 62, the engine for the sweeping machine may be engaged and power supplied to the pump 63 which will supply fluid to the drive motors for the main and gutter brooms and filter fan. Once debris has been collected within the hopper 38, the sweeping machine is elevated by raising the vertical support bars of the forklift as shown in FIG. 4 and the machine is positioned above a collection receptacle C. Thereafter the hydraulic cylinder 41 is activated to pivot the housing 39 and thereby dump the contents from the hopper into the collection receptacle.

We claim:

1. A sweeping machine which is selectively attachable to the lift bars of the vertical mast of a conventional forklift truck comprising, a frame, said frame having a vertical portion which extends upwardly with respect to a pair of side beam members, at least one wheel means for supporting said frame and extending downwardly with respect thereto, a cylindrical brush means, means for mounting said cylindrical brush means relative to said side beam members of said frame, first motor means for rotating said cylindrical brush means, a collection hopper mounted adjacent to said cylindrical brush and having an opening therein for receiving debris being swept by said cylindrical brush means, a portion of said frame including hollow beam members, said hollow beam members forming a fluid reservoir for hydraulic fluid, pump means mounted relative to said frame, means for driving said pump means, a hydraulic motor for driving said cylindrical brush means, means for connecting sad pump means to said hydraulic motor means, at least one mounting plate means for engaging the lift bars of the forklift, and at least one pivotable link means for connecting said frame to said mounting plate whereby said frame will be relatively free to move vertically relative to the forklift lift bars as said at least one wheel means traverse a support surface.

2. The sweeping machine of claim 1 including means for pivotably mounting said collection hopper relative to said side beam members of said frame.

3. The sweeping machine of claim 2 in which said collection hopper forms a portion of a pivotable enclosure, a filter means mounted in fluid communication with said collection hopper and within said pivotable enclosure, and fan means mounted within said pivotable enclosure for circulating air through said filter means, and means for operating said fan means.

4. The sweeping machine of claim 3 including a stationary housing mounted adjacent to said pivotable enclosure and partially surroundings said cylindrical brush means, an exhaust opening between said pivotable enclosure and said stationary housing whereby exhaust air from said fan means is directed into said stationary housing adjacent said cylindrical brush means.

5. The sweeping machine of claim 4 including hydraulic motor means for driving said fan means.

6. The sweeping machine of claim 1 including a rotary brush means, means for mounting said rotary brush means outwardly with respect to said frame and a second hydraulic motor means for driving said rotary brush means.

7. The sweeping machine of claim 1 including at least two mounting plates means, each of said mounting plate means including upper and lower opposing flange portions for engaging the lift bars of the forklift therebetween, first lug means extending outwardly from said mounting plate means and second lug means mounted to said frame, said link means extending between and connecting said first and second lug means.

8. The sweeping machine of claim 7 including a wear plate means mounted to said frame means in spaced relationship below said link means, said wear plate means being engagable by said mounting plate means when said frame is raised by the lift bars of the forklift truck.

9. The sweeping machine of claim 1 in which said collection hopper is pivotably mounted relative to said side beam members of said frame, a hydraulic cylinder means, said hydraulic cylinder means including extension rod, said extension rod being pivotably connected to said collection hopper and means for supplying fluid pressure to said hydraulic cylinder means.

10. A sweeping machine which is selectively attachable to the lift bars of the vertical mast of a conventional forklift truck comprising, a frame, said frame having a vertical portion which extends upwardly with respect to a pair of side beam members, wheel means for supporting said frame and extending downwardly with respect thereto, a cylindrical brush means, means for mounting said cylindrical brush means relative to said side beam members of said frame, first motor means for rotating said cylindrical brush means, a collection hopper mounted adjacent to said cylindrical brush and having an opening therein for receiving debris being swept by said cylindrical brush means, at least two mounting plate means, each of said mounting plate means including upper and lower opposing flange portions for engaging the lift bars of the forklift, lug means extending outwardly from each of said mounting plate means, a pair of pivotable link means, means for connecting said link means to said frame and to said lug means whereby said frame will be relatively free to move vertically relative to the forklift lift bars as said wheel means tranverse a support surface.

11. The sweeping machine of claim 10 in which said collection hopper forms a portion of a pivotable enclosure, a filter means mounted in fluid communication with said collection hopper and within said pivotable enclosure, and fan means mounted within said pivotable enclosure for circulating air through said filter means, and means for operating said fan means.

12. The sweeping machine of claim 11 including a rotary brush means, means for mounting said rotary brush means outwardly with respect to said frame means and a second motor means for driving said rotary brush means.

* * * * *